US006295984B1

(12) United States Patent
Patel

(10) Patent No.: US 6,295,984 B1
(45) Date of Patent: Oct. 2, 2001

(54) DIVER'S BACKPACK

(76) Inventor: Payal Patel, 1901 Candlelight Ct., Friendswood, TX (US) 77546

( * ) Notice: Subject to any disclaimer, the term of this patent is extended or adjusted under 35 U.S.C. 154(b) by 0 days.

(21) Appl. No.: 09/374,197

(22) Filed: Aug. 13, 1999

(51) Int. Cl.[7] ..... B63C 11/02; A61M 15/00

(52) U.S. Cl. ..... 128/201.27; 128/202.26

(58) Field of Search ..... 128/201.27, 201.11, 128/201.21, 201.19, 201.28, 202.26, 205.24, 205.22, 205.25, 913, 200.25, 202.25; 405/186, 187; 422/120, 164; 205/633

(56) References Cited

U.S. PATENT DOCUMENTS 3,293,851 * 12/1966 Hulbert et al. ..... 128/204.26
3,504,669 * 4/1970 Albert ..... 128/204.26
3,616,436 * 10/1971 Haas ..... 204/129
3,674,022 * 7/1972 Dounoucos ..... 128/142
3,971,372 * 7/1976 Lenk et al. ..... 128/204.26
4,779,554 * 10/1988 Courtney ..... 114/315
5,365,868 * 11/1994 Culotta ..... 114/315
5,720,279 * 2/1998 Furuichi et al. ..... 128/204.26
5,803,062 * 9/1998 Aulgur ..... 128/202.26
5,839,435 * 11/1998 Matsuoka et al. ..... 128/204.26
5,924,418 * 7/1999 Lewis ..... 128/204.26
6,155,254 * 12/2000 Evrard et al. ..... 128/202.26

* cited by examiner

*Primary Examiner*—John G. Weiss
*Assistant Examiner*—Teena Mitchell
(74) *Attorney, Agent, or Firm*—Bracewell & Patterson, L.L.P.

(57) ABSTRACT

This disclosure is directed to a backpack comprising a frame with straps and surrounding side wall for easy attachment on a diver. A first gas storage tank stores either oxygen or air, which is input through an inlet line. With a pressure regulator, it delivers a flow of gas to feed the diver while diving. As the pressure drops in the gas tank, a secondary source of oxygen is then operated and delivers a flow of oxygen to the diver so that the diver is able to receive supplemental oxygen stored in the gas storage tank formed by electric current flowing through a pair of spaced terminals. The terminals form oxygen by disassociation of water. The oxygen is bubbled upwardly in a chamber, pass though a hydrophobic valve, delivered into the gas storage tank, and supplements the oxygen supply.

14 Claims, 1 Drawing Sheet

DIVER'S BACKPACK

BACKGROUND OF THE DISCLOSURE

This disclosure is directed to a backpack for use by a diver. The backpack is sized so that it fits on the back of an average sized adult. It is supported at a convenient location. It provides assistance to the diver in several ways. First, it is equipped with a battery which is electrically charged on the shore. The backpack includes two tanks in it. One is reserved for oxygen. It can be precharged on shore. It can be charged with pure oxygen or with air from the atmosphere to provide an initial charge of oxygen. The backpack thus provides a charged cylinder filled with air or oxygen which enables the user to stay under water for a specified interval. When that tank runs low, the system then notes the drop in tank pressure, and at that time switches on a battery. The battery in conjunction with two electrodes deployed at spaced locations in a chamber then receives water and converts that water into oxygen and hydrogen. The two electrodes are spaced apart. They are located at a spacing prompting the bubbles to rise in the chamber. The bubbles formed by the disassociation of water into the two component gases are segregated by appropriate electrode spacing in the chamber. This enables the oxygen to be collected, compressed and stored to the tank for the diver. This will extend the duration of use.

Interestingly, the hydrogen which is formed by the disassociation can be used in any one of three different ways. Among other things, it can be used to power a motor, or it can be used as an expansion chamber fluid. By inflating an expansion chamber, thereby making the backpack larger, buoyancy is changed. The buoyancy prompts a force floating the diver because the change in the buoyancy of the backpack will then help bring the diver back to the surface. Accordingly, the hydrogen created by the disassociation will later, nevertheless, have value. The value of the hydrogen is therefore appropriately noted and is used in any of the several ways just mentioned.

To put a scale on this structure, assume that the system incorporates an oxygen tank which holds an adequate supply. By positioning a battery in the backpack and using the battery for water disassociation into oxygen, the same tank can be steadily recharged while the diver is consuming the gas of the original charge. Commonly, the equipment would have to be retrieved to the surface after a typical one hour interval. Through the use of the disclosed system, a continuous recharge can be initiated. The swimming interval can be extended to the extent that the charge in the battery permits.

In one important aspect, the present apparatus is a completely self contained mobile device which does not impede or otherwise slow down the diver. It is a system which is relatively compact. While compact, it can be constructed readily for easy mounting on the back so that the swimmer is not aware that it is present. Yet, while small and compact, it can carry a charge which is able to sustain the swimmer for a much longer interval. To be sure, heavy wall, high pressure gas cylinders can be used to extend the swimming duration. These heavy cylinders may seem easy to handle under water. They are, however, often made of very thick walls to define a relatively heavy structure. In this instance, a lighter gauge storage tank can be used. While lighter in wall thickness and lighter in total weight, a longer duration is obtained through the use of the battery powered system which furnishes a discharge of oxygen so that a small tank or a large tank at a lower pressure, hence a lighter weight tank, can be progressively refilled during use. Since refilling occurs ratably, the system of the present disclosure need not operate at high speed. Rather, it can generate enough oxygen to make up for oxygen consumption at a controlled rate, a rate typically in the range of 25% to 60% of the rate at which the swimmer requires oxygen. By using it as a booster to add to an initial charge, smaller equipment can be used. Thinner walls in the equipment can be used so that the aggregate weight in reduced. Finally, it has the value of forming an added byproduct (hydrogen gas) which can be used elsewhere in the system. One use of the generated hydrogen is to power a motor which assists the swimmer by providing a motive force. Another use operate a hydrogen or gas powered motor to sound a motor powered marker such as an alarm marker. Another use is to inflate an expansion chamber so that buoyancy can be increased at the flip of a switch, thereby changing the buoyancy of the diver and quickly returning the diver to the surface.

BRIEF DESCRIPTION OF THE DRAWINGS

So that the manner in which the above recited features, advantages and objects of the present invention are attained can be understood in detail, more particular description of the invention, briefly summarized above, may be had by reference to the embodiments thereof which are illustrated in the appended drawings.

It is to be noted, however, that the appended drawings illustrate only typical embodiments of the invention and are therefore not to be considered limiting of its scope, for the invention may admit to other equally effective embodiments.

Figure 1:
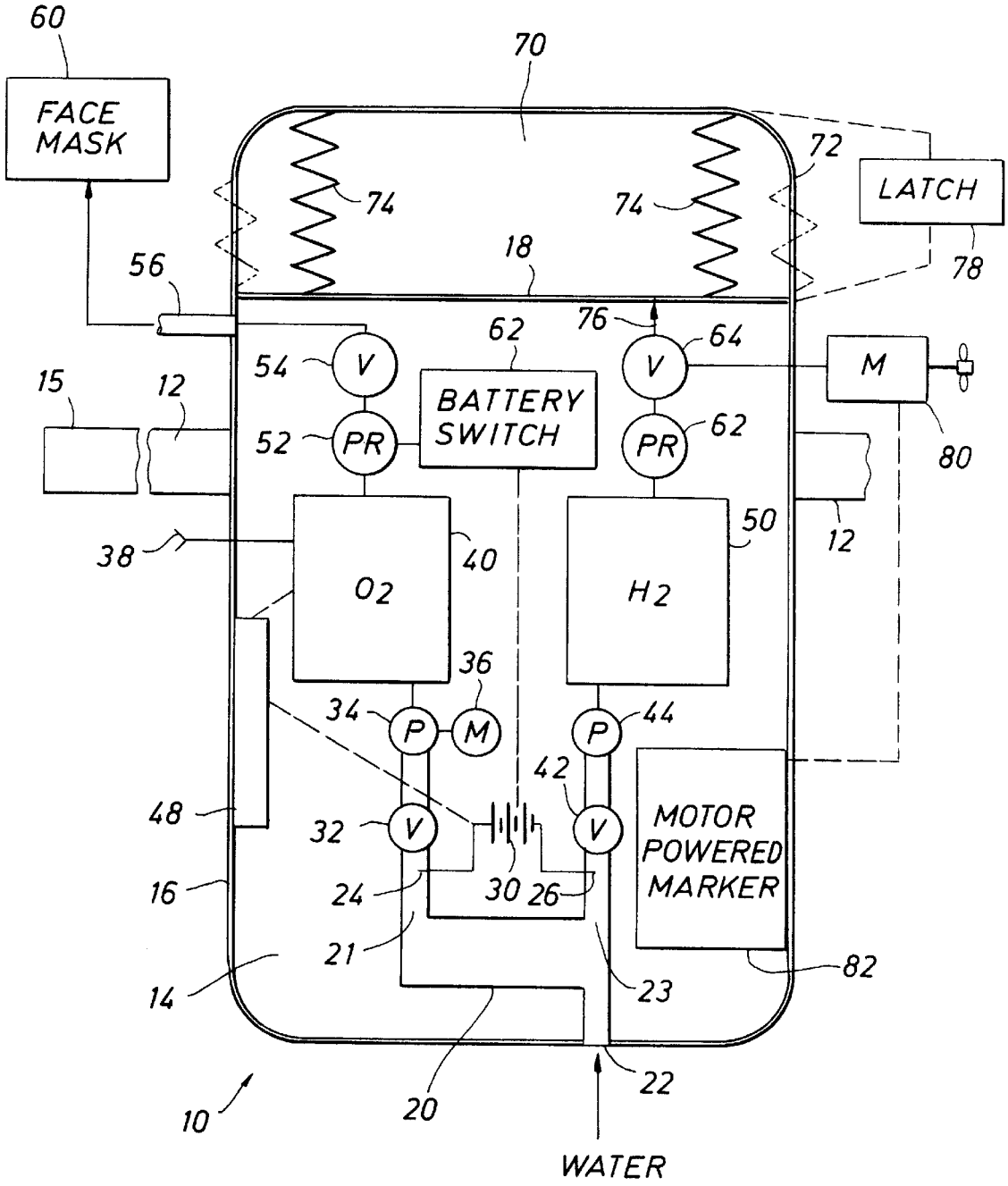

The single drawing shows the backpack of the present invention which incorporates oxygen forming equipment.

DETAILED DESCRIPTION OF THE PREFERRED EMBODIMENT

Attention is now directed to the only drawing which shows a backpack 10 constructed in accordance with the present disclosure. It is mounted with a strap 12 reaching around the user. The strap 12 connects with a suitable clasp or buckle 15 which grabs the other end of the strap. One or two straps are typically used. The straps can reach around the waist, around the chest, or they can extend up and over the shoulders and reach around the arms, all as desired by the user. Leg straps also can be conveniently incorporated. As illustrated in the only drawing, the backpack is constructed on a diver supported mounting frame 14 which is essentially a covered board or frame contacted against the back of the user. Typically, the backpack covers the region of the back extending from just below the shoulders down to the area of the waist, and perhaps a bit lower to the hips of the user. The frame 14 defines a structure which is encompassed within a side wall 16. The side wall 16 has a specified height so that there is an adequate depth within the backpack. The backpack includes a number of components which are mounted on the frame 14. The components have a size so that they fit within the side wall 16. The side wall 16 is solid on most of the periphery. The side wall 16 cuts straight across at the top in a segment 18. The frame 14 also extends up to the straight wall segment 18. There is a collapsible expansion chamber there which will be discussed in some detail later.

The backpack has a small opening at the lower end which opens into a water tank 20. The tank 20 is provided with water admitted through the opening 22. The tank has two upwardly extending electrode chambers 21 and 23. There are electrodes 24 and 26 in the tank. Electrodes 24 and 26 are connected with a battery 30. The battery 30 is electrically wired so that the electrode 24 forms a disassociation gas product which is essentially oxygen. The oxygen is trapped so that it bubbles upwardly. In like fashion, the other electrode 26 forms a disassociation gas. It is also collected and accumulated, it being noted that both gases rise by gravity in the tank 20. Preferably, this equipment is used where it is not inverted. There is the risk of collecting gases at the wrong raised portions of the chamber 20. More will be noted concerning that hereinafter.

Duplicate systems are provided for removing the gases from the chamber 20. The numeral 32 identifies a hydrophobic valve. This is a valve which permits the escape of gas collected in that part of the chamber. Typically, the hydrophobic valve is light weight and buoyant so that it rises if water comes up in that chamber. This prevents the escape of liquid through the valve 32. It flows from the valve 32 into a pump 34. The pump 34 is powered by a motor 36 which operates in a manner to be described. That compresses the oxygen to overcome the ambient pressure in the oxygen tank 40. The tank 40 has an inlet line 38 which has an external fitting, thereby enabling the tank to be provided with an initial charge. An example will be given below. In addition to that, comparable equipment on the other side is also shown. It utilizes the valve 42 which again is a hydrophobic valve and that also operates in conjunction with a pump 44. This enables the filling of the hydrogen tank 50 with the second gas made by the second electrode. Typically, the tank 50 is similar to the tank 40 except that it can be smaller. Also, it can be smaller and since it does not receive an initial charge, it can be constructed to operate at lower pressures. By that, it stores a much smaller volume and has a good deal less weight.

The tank 40 delivers oxygen out through a pressure regulator 52. In turn, that delivers a flow of gas through the valve 54. The valve 54 is connected with a gas supply line 56 which connects with the face mask 60. The face mask provides oxygen for the swimmer. The pressure sensor 48 responds to pressure loss with time (as oxygen is burned) to turn on the battery 30 and start the process; it responds to the tank 40 pressure.

Consider a typical sequence of operations. Assume that the tank 40 is initially charged with gas. As a convenience, it can be provided with a mixture of oxygen at the ratio of anywhere from 20%, which is common in the atmosphere, up to maybe 50% or 60%. It is possible to mix the gas so that there is some neutral or essentially inert gas in the tank. The tank 40 is then used as the primary supply tank. As noted, it can be filled with 100% oxygen, or it can be initially charged with any lesser proportion. Assume that it is charged to an arbitrary pressure of 100 psi. While swimming occurs, flow is discharged through the pressure regulator and outlet valve. Flow is delivered through the gas supply line 56 into the face mask for use. Assume for purposes of discussion that the tank is discharged steadily by use from the initial charge of 100 psi. Assume arbitrarily that the pressure drops from 100 psi in the tank to 50 psi. This pressure drop is then sensed by a battery switch 62 which responds to the drop in pressure. It then operates, the dotted line connection in the drawing indicating that the battery switch 62 is operated to thereby connect the battery 30 to the two terminals. The water in the tank 20 is disassociated and forms a stream of oxygen in the form of oxygen bubbles. These bubbles rise and collect under the valve 32. When there are enough bubbles at that area, they permit the valve to drop because it is a hydrophobic element, and thereby force the oxygen under the valve 32 up though the valve and then through the pump 34. The pump 34 delivers the oxygen into the tank dependent on the back pressure.

There are conditions for which the pump does not need to operate. Consider as an example a diver who is at a depth of 200 feet. Roughly, the pressure at that depth is about 100 psi, ignoring the external atmospheric pressure factor. At an ambient water pressure of 100 psi, water is easily introduced into the tank 20 and continues to fill that tank as the water is disassociated. With the pressure in the tank 20 approximating the prevailing pressure outside the diver, the tank will then experience a pressure of 100 psi. The valve 32 will be forced upwardly by this water pressure as long as water acts against it and it is raised by its own buoyancy. When a large bubble of oxygen accumulates under the valve 32, it will drop and make a transfer of the gas, not the water, through the pump 34 and into the tank 40. If at that time the tank 40 pressure is less than the water pressure, there is no need to operate the pump 34. On the other hand, if the pressure in the tank 40 is high, and it is higher than the prevailing water pressure outside the diver, then it may be necessary to selectively turn on the motor 36 and operate the pump to force oxygen past the valve 32 and into the storage tank 40.

Essentially, the same kind of problem is encountered with the other electrode which forms a discharge of hydrogen gas. There is, however, a substantial difference as a result of the change in scale. The volume of hydrogen gas is much less, and it is much lighter per unit volume. The tank 50 is therefore much smaller. The tank 50 also need not operate at comparable dynamic pressures. If the tank 40 is safely constructed for 200 psi and is routinely operated with a very substantial safety margin, and if it has a capacity of five liters, the tank 50 preferably has a capacity of about one liter and is derated compared to the tank 40. It can be constructed for operation at half the wall strength and half the pressure, and still have more than ample structural integrity for the task at hand. Moreover, the hydrogen discharge is delivered through a comparable valve 42 and a comparable pump 44. Again, the same situation is faced, namely, the pump 44 may not be required because the back pressure in the tank 50 may be less than the ambient pressure at the depths of the swimmer. If the tank 50 is essentially at atmospheric pressure, the back pressure problem is substantially eliminated, and in that case, the pump 44 can be omitted or switched off, as the case may be. The hydrogen tank 50 has an associated pressure regulator 63. It operates with a comparable valve 64. In this instance, the valve is switched to any of several connections or positions. One use is delivery of the hydrogen from the tank 50 into an expansion chamber 70. The chamber 70 is constructed to change the buoyancy of the diver. It is crushed or collapsed, it being observed that there is a flexible side wall 72 which extends to the full line shape illustrated, but collapses with a set of pleats represented by the dotted line representation in the drawing. By collapsing, the chamber 70 is reduced to a minimum volume. Expansion can be obtained by the elongation of a pair of expansion springs 74 which are located at the opposite ends of this chamber. Moreover, the expansion chamber in its initial condition is collapsed so that essentially it has nothing in it. The valve 64 connects to the expansion chamber 70 through a feed line 76. The feed line 76 enables filling that chamber. Since it is filled with hydrogen gas, it is very light and creates a significant change in buoyancy. The chamber 70 is controllably activated by use of a latch 78 which is used by the diver to change the height of the chamber, hence, to change the buoyancy of the chamber. This chamber is optionally filled, as noted, by the gas vented through the line 76.

Another destination for gas subject to control by the valve 64 is delivery of the gas to a motor 80. The gas can be used simply as a flowing compressed gas to rotate a propeller. It is not uncommon for divers to assist it movement by using a motor driven propeller. This enables swimming at a faster rate. Alternately, the motor 80 can be connected to a motor powered marker 82. By suitable connection of the motor 80 into the marker 82, a noise maker can be operated. The noise maker can be used to mark the location of the diver, form signals to other divers in the vicinity, or can be used as a noise maker to frighten threatening fish and other aquatic life.

While the foregoing is directed to the referred embodiment, the scope of the present disclosure is determined by the claims which follow:

1. A backpack for a diver which comprises:

(a) a diver-supported mounting frame;

(b) an oxygen storage tank for receiving a charge of oxygen therein;

(c) a gas line extending from the oxygen storage tank for providing oxygen to a diver;

(d) an oxygen generator on the mounting frame for generating oxygen from the electrolysis of water admitted into the oxygen generator while the backpack is underwater, wherein the generated oxygen is delivered into the oxygen storage tank; and (e) a hydrogen storage tank and a backpack expansion chamber having a closed condition and an opened condition wherein said closed condition is collapsed and said expansion chamber expands to change the buoyancy of said backpack by admitting hydrogen to the expansion chamber from the hydrogen storage tank.

2. The apparatus of claim 1 including a battery source connected through a battery switch to operate said oxygen generator.

3. The apparatus of claim 2 wherein said oxygen generator comprises a pair of spaced electrodes in a closed chamber to initiate oxygen generation of water in the closed chamber.

4. The apparatus of claim 1 wherein said oxygen storage tank has an output through a pressure regulator.

5. The apparatus of claim 4 wherein said pressure regulator comprises means for responding to a specified pressure for the oxygen storage tank, and upon achieving a specified pressure, operating said oxygen generator.

6. The apparatus of claim 1 wherein said oxygen generator comprises:

(a) a water tank having a water inlet for admitting water into said tank;

(b) first and second spaced and separated electrode chambers defining the closed chamber in communication with water therein;

(c) raised gas traps in said electrode chambers respectively located above said electrodes wherein said gas traps accumulate gas formed by electrical disassociation in said water tank at said electrodes;

(d) first and second gas removing valves above said first and second electrodes for removing gas formed in said electrode chambers;

(e) first and second valve-connected lines for delivery of gas formed in said oxygen generator extending respectively to the oxygen storage tank and to a hydrogen storage tank.

7. The apparatus of claim 6 wherein said oxygen storage tank hydrogen storage tank.

8. The apparatus of claim 5, further comprising an external inlet line coupled to the oxygen storage tank, and wherein the oxygen storage tank is adapted to receive an external charge via the external inlet line prior to use of the backpack on a diver in water.

9. The apparatus of claim 8 wherein said oxygen generator receives electric current from a battery and said battery is constructed with a battery switch operating said battery upon pressure reduction in said gas storage tank.

10. The apparatus of claim 1 further comprising a hydrogen storage tank and a backpack expansion chamber having a closed condition and all opened condition wherein said closed condition is collapsed and said expansion chamber expands to change the buoyancy of said backpack by admitting hydrogen to the expansion chamber from the hydrogen storage tank.

11. The apparatus of claim 1 wherein said backpack supports a supplemented gas storage system including said oxygen storage tank and further comprises:

(a) an inlet line into said oxygen storage tank having an end exposed for introduction of gas prior to entering the water so that said oxygen storage tank is filled with an initial charge of a predetermined volume;

(b) a pressure regulator connected to said oxygen storage tank;

(c) a connection for said gas line extending from said pressure regulator to provide gas including oxygen for the driver; and (d) a supplemental line into said oxygen storage tank from said oxygen generator to deliver oxygen therefrom for said oxygen storage tank to supplement the initial charge in said oxygen storage tank.

12. The apparatus of claim 10, further comprising a propulsion motor driven by hydrogen from the hydrogen storage tank and a propeller driven by the propulsion motor.

13. The apparatus of claim 12, further comprising a sound marker actuated by the propulsion motor.

14. A backpack for a diver comprising:

(a) a diver-supported mounting frame;

(b) an oxygen storage tank for receiving a charge of oxygen therein;

(c) a gas line extending from the oxygen storage tank for providing oxygen to a diver; and (d) an oxygen generator on the mounting frame for generating oxygen from the electrolysis of water admitted into the oxygen generator while the backpack is underwater, wherein the generated oxygen is delivered into the oxygen storage tank;

(f) wherein said oxygen storage tank has an output through a pressure regulator comprising means for responding to a specified pressure for the oxygen storage tank and, upon reaching the specified pressure, operating the oxygen generator; and (g) and further comprising an external inlet line coupled to the oxygen storage tank, and wherein the oxygen storage tank is adapted to receive an external charge via the external inlet line prior to use of the backpack on a diver in water.

* * * * *